US005974599A

United States Patent [19]

Tudor

[11] Patent Number: 5,974,599

[45] Date of Patent: Nov. 2, 1999

[54] SPA COVER LIFTING DEVICE

[76] Inventor: E. Jess Tudor, 112 Henry Ct., Tracy, Calif. 95376

[21] Appl. No.: 09/005,079

[22] Filed: Jan. 9, 1998

[51] Int. Cl.[6] ..... E04H 4/00

[52] U.S. Cl. ..... 4/498; 4/500

[58] Field of Search ..... 4/498, 500, 503, 4/496, 546, 559

[56] References Cited

U.S. PATENT DOCUMENTS 4,853,985 8/1989 Perry .
5,048,153 9/1991 Wall et al. .
5,131,102 7/1992 Salley et al. .
5,517,703 5/1996 Ouelette .
5,584,081 12/1996 Ouelette .
5,634,218 6/1997 Ouelette .
5,689,841 11/1997 Black et al. ..... 4/498
5,819,332 10/1998 Perry ..... 4/498

*Primary Examiner*—David J. Walczak
*Attorney, Agent, or Firm*—Bielen, Peterson & Lampe

[57] ABSTRACT

A spa cover lifting device for lifting a folding spa cover seated on a spa from a seated position to a vertical storage position, the spa cover lifting device having a frame apparatus with a horizontal cross member and a pair of side members with ends having pivot means connectable with the spa, the horizontal cross member engaging the folding spa cover at the fold and transporting the cover when folded over the cross member from the seated position to the storage position when the frame apparatus is pivoted.

11 Claims, 2 Drawing Sheets

SPA COVER LIFTING DEVICE

BACKGROUND OF THE INVENTION

This invention relates to a spa cover lifting device, and in particular, to a mechanism provided in kit form to facilitate the removal, storage and replacement of insulated spa covers of the type having a centerfold. The spa cover lifting device of this invention was designed to ease the burden of removing and replacing spa covers by equipping a water spa with a mechanism that lifts and conveniently stores the spa cover for easy removal and replacement.

The spa cover lifting device is preferably provided in kit form to allow the adjustable lifting device to be assembled and utilized with a variety of different-sized spa covers. In addition to removing and replacing the spa cover, the lifting device is constructed to conveniently support the spa cover in an elevated position adjacent the spa to extend the useful life of the spa cover and prevent its premature damage.

The spa cover lifting device includes a pivoting frame apparatus that engages the spa cover at its centerfold and transports the folded cover to a convenient location adjacent the spa on which the cover is deployed. The pivoting frame apparatus has a unique configuration to enable the pivoted cover to be positioned in a low-profile, vertical folded condition against the spa. Additionally, the unique configuration of the frame apparatus enables the frame itself to be displaced to a position that minimally interferes with the use of the spa. Furthermore, the kit form of the spa cover lifting device enables the mechanism to be easily assembled and adapted to a particular manufacturers spa and cover configuration with minimal installation labor. These and other features of the invented spa cover lifting device will become apparent from the following summary and detailed description of the preferred embodiments.

SUMMARY OF THE INVENTION

The spa cover lifting device of this invention comprises a lifting mechanism for a folded spa cover that is commonly used to cover and insulate a heated spa.

The term "spa" is used to generally describe a hot tub or other bath facility with a whirlpool that is customarily used at home or at an apartment or condominium complex. In general, a volume of water in the spa is maintained heated for an extended period of time and it is therefore desirable to cover the spa with a cover that provides a thermal insulation for the heated water in addition to protection from debris. The lifting mechanism includes a frame apparatus that is pivotally connected to the spa or to the housing or support structure of the spa. The frame apparatus preferably has telescoping elements that permit adjustment of the frame apparatus to spa covers of different size that are sold as standard equipment or as separate accessories to a spa.

A conventional spa is typically constructed with an inner water container with external water heating and circulating systems for circulating heated water to the inner container. The inner container and circulating conduits are typically housed in a cabinet or in a support pedestal which provides an exterior surface for attachment of the lifting mechanism. Details of the internal construction of the spa are omitted in this description as being unnecessary to the structure and operation of the lifting device of this invention.

The spa cover lifting device is utilized in conjunction with a spa cover of the folding type that includes a thick, padded cover piece that is centrally folded to facilitate the removal, placement and storage of the cover. The lifting device of this invention not only assists in removal and replacement of the cover, but is designed to conveniently store the cover in a suspended position to preserve the form of the cover piece and maintain the cover in an elevated position to prevent contact with the ground, which may be damp with spilled or splashed spa water. The lifting device thereby minimizes handling of the spa cover during use of the spa, which avoids damage and greatly extends the useful life of the cover. These and other advantages will become apparent upon a consideration of the detailed description as follows.

DETAILED DESCRIPTION OF THE PREFERRED EMBODIMENTS

Figure 1:
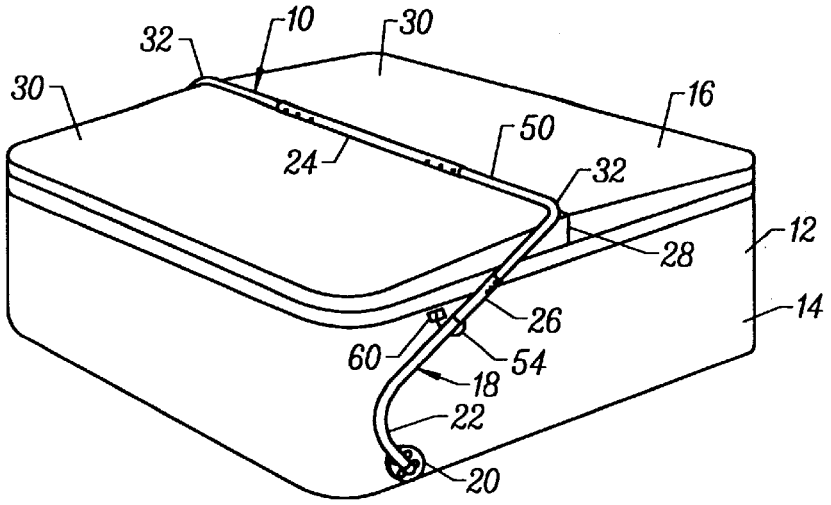
FIG. 1 is a perspective view of the spa cover lifting device installed on a spa and attached to a spa cover.

The spa cover lifting device of this invention is shown in FIG. 1 and the lifting device is designated in general by the reference numeral 10. The lifting device 10 is shown pivotally mounted to a spa 12 having a generally rectangular housing structure forming an outer cabinet 14 with a folding spa cover 16 situated on the spa.

The spa cover lifting device 10 comprises a lifting mechanism 18 with a pivotal mount 20 and a frame apparatus 22 that includes a cross member 24 and side members 26 connected to the cross member to form a U-shaped yoke with the side members positioned to depend on opposite sides of the housing structure. The folding spa cover 16 is of typical construction with a cover 16 having a central fold 28 forming two sections 30. The central fold 28 is aligned with the cross member 24 of the frame apparatus 22, enabling the spa cover to be folded over the cross member 24 for removal.

Figure 2:
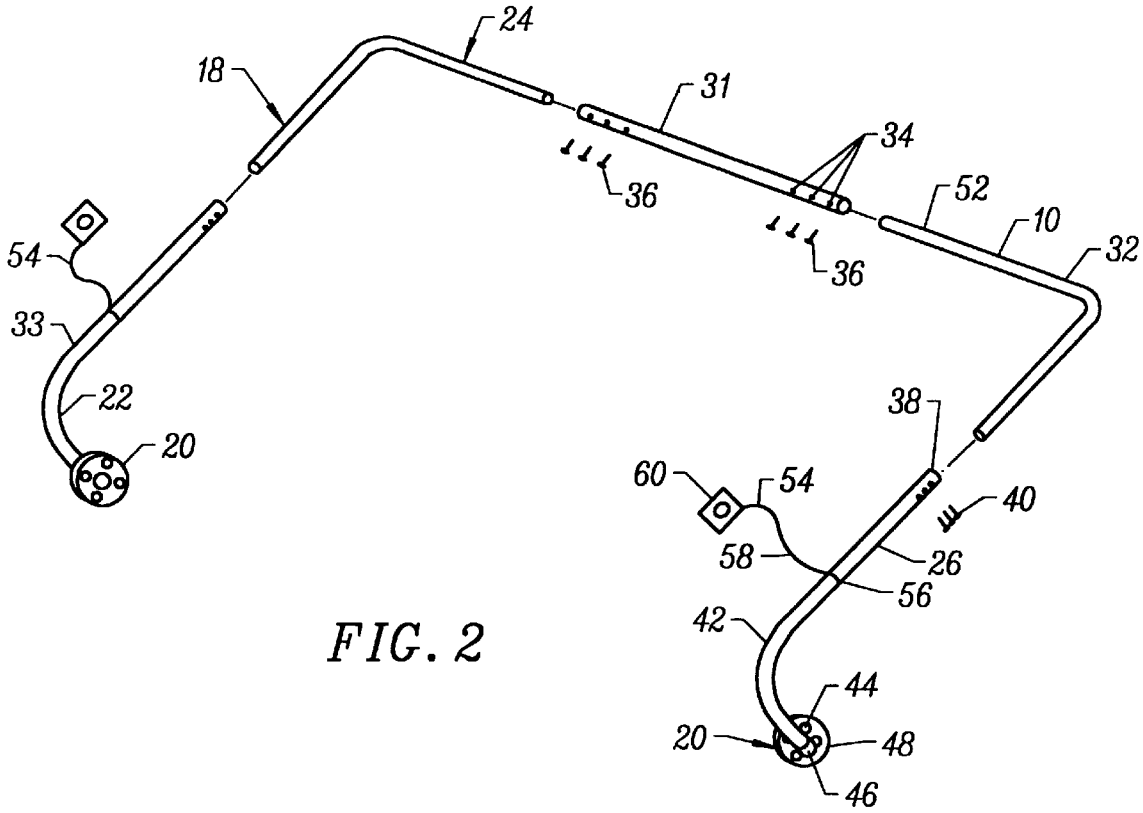
FIG. 2 is a perspective view, partially exploded of the elements of the lifting mechanism of the spa cover lifting device of FIG. 1.

The spa cover lifting mechanism 18 is shown in FIG. 2 with the component elements exploded to show the kit form of the lifting device 10. As shown in FIG. 2 the cross member 24 includes a spreader bar 31 that is connected to each of two corner elements 32 that when interconnected form part of the cross member 24 and side members 26. The corner elements 32 are slightly smaller in diameter than the spreader bar 31 and a pair of bent pivotal elements 33 that form the major part of the side members 26. This allows the corner elements 32 to insert into the ends of the spreader bar 31 and pivotal elements 33. The spreader bar 31 includes a series of spaced holes 34 to receive self tapping screws 36 that fixedly connect the spreader bar 31 to the corner elements 32 during installation and adjustment. Similarly, the pivotal elements 33 include holes 38 for a fixed connection of the pivotal elements 33 to the corner elements 32 using self threaded screws 40 during installation and adjustment. The pivotal elements 33 include a bend 42 and an end 44 that is press-fit into a nipple and elbow assembly 46. The elbow assembly 46 threadably and pivotally engages a cabinet flange 48 that is adapted to connect to a part of the spa structure. The threadable engagement of the elbow assembly 46 and the flange 48 allows the assembled lifting mechanism 18 to be pivoted about the flange 48 using the threaded interconnection as a bearing surface.

Preferably, the spreader bar 31 and pivotal elements 33 are fabricated from aluminum tube stock bent in the configuration shown with a 90 degree angle on an 8 inch radius. The corner elements 32 are preferably fabricated from tubular steel stock providing the necessary strength for the smaller diameter tube. The steel tube is galvanized steel, powder coated and bent at an angle of 87 degrees. This allows the horizontal cross member 24 that is formed by the spreader bar 31 and the horizontal segments 52 of the corner elements 32 be sized according to a particular spa cover with sufficient spread to permit connection to the elbow assemblies 46 of the pivotal mounts 20.

To limit the travel of the frame apparatus 22, the lifting mechanism 18 includes a pair of tethers 54 which are attached to the pivotal elements 33 by a loop 56 of a tether cable 58 which connects each of the pivotal elements 33 to a tether bracket 60, which is attached with the wood screws (not shown) to the cabinet 14 of the spa 12 as shown in FIG. 1. The tether 54 limits the pivot of the frame apparatus 22 during the removal of the spa cover 16 and the suspended storage of the spa cover adjacent one side of the spa 12 as shown in the sequence of FIGS. 3–5.

Figure 3:
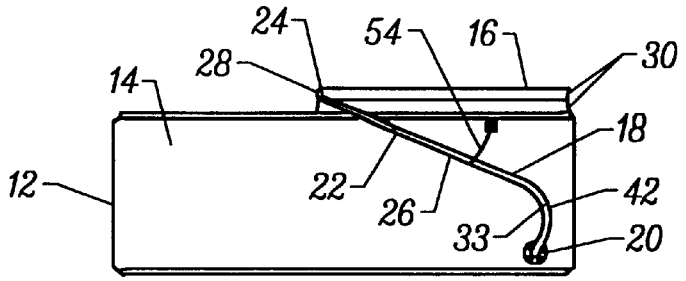
FIG. 3 is a schematic view of the spa cover lifting device in a first position.
Figure 4:
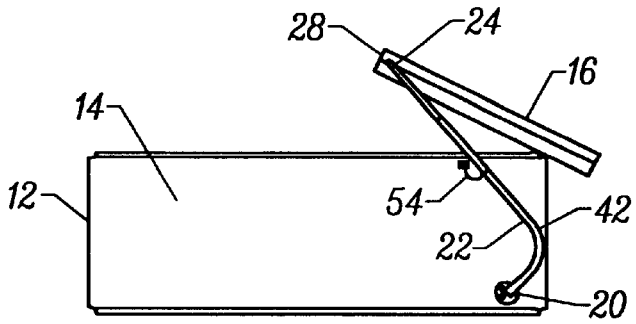
FIG. 4 is a schematic view of the spa cover lifting device in a second, intermediary position.
Figure 5:
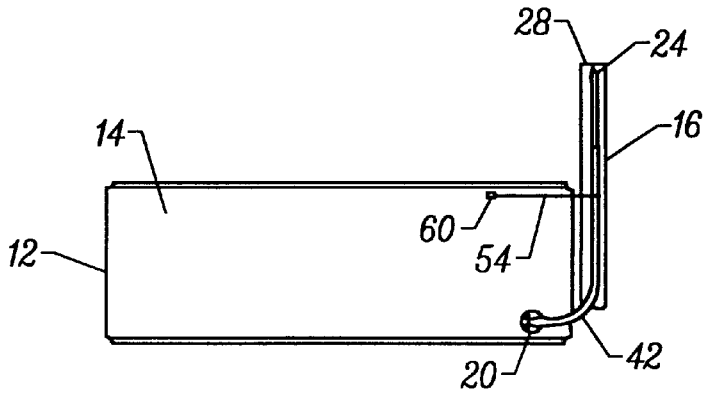
FIG. 5 is a schematic view of the spa cover lifting mechanism in a third storage position.

Referring to FIGS. 3–5 the lifting mechanism 18 is shown mounted to the cabinet 14 of the spa 12 by the pivotal mounts 20. Side members 26 are oriented in the position in which the cross member 24 is contained within the central fold 28 of the spa cover 16, which in FIG. 3 is shown with its sections 30 folded one upon the other. In this position, the tether 54 is slack. As a user lifts the spa cover by pivoting one of the side members 26 on the pivotal mount 20, the folded spa cover 16 is lifted at the central fold 28 and displaced over the spa 12 as shown in FIG. 4, toward one end of the spa 12.

As shown in FIG. 5 when the frame apparatus 22 reaches the appropriate position to vertically suspend the folded spa cover 16 adjacent the spa 12, the tether 54 becomes taut and retains the frame apparatus 22 in the optimum position. It is to be understood that the bend 42 in the pivotal elements 33 allows the spa cover 16 to be lifted with a minimum elevation and to be conveniently located adjacent or proximate one end of the spa 12 as shown in FIG. 5. Additionally, the bent contour of the pivotal elements 33 enables the frame apparatus 22 to be conveniently positioned in an out-of-the-way position to minimize any interference with users of the facility. The "forward fulcrum" design of the side members 26 effectively increases the horizontal travel to vertical lift ratio of the spa cover 16 allowing the suspension of the cover on the cross member 24 to be lower than if a straight lever arm were used. The lowered profile of the spa cover 16 during storage minimizes injury from gusting wind or reckless play.

In assembling the lifting mechanism 18, the spreader bar 31 is positioned in the middle of the spa cover 16 at one side of the central fold 28. The corner elements 32 are installed by telescoping into the spreader bar 31 and then into the pivotal elements 33. The side members 26 are positioned on the cabinet 14 and the pivotal mount 20 is positioned and secured to the cabinet 14 using conventional wood screws. The spreader bar 31 is rotated to position the spaced holes 34 away from the fold 28 to minimize contact of the cover by the screws 36 when installed to minimize wear during the transport process. The corner elements 32 and pivotal elements 33 are secured after final adjustment. The frame apparatus 22 is positioned to the vertical position as shown in FIG. 5 to locate and secure the bracket 60 of the tether 54 so that the tether is taut when the lifting mechanism 18 is so positioned when carrying the folded spa cover. The tether brackets 60 are secured to each side of the cabinet 14 with wood screws (not shown). To lift the spa cover 16, the cover is simply folded over the cross member 24 and one of the side members 26 is manually pivoted until the tether becomes taut. The cover is automatically transported to the vertical storage position adjacent the spa.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A spa cover lifting device for removing, storing and replacing a folding spa cover that is seated on a spa having a generally rectangular housing structure with sides, the lifting device comprising:

a lifting mechanism including a frame apparatus having a horizontal cross member over which the spa cover is foldable and a pair of side members connected to the horizontal cross member wherein a U-shaped yoke is formed with the side members being positionable to depend on opposite sides of the housing structure of the spa, the side members each having an end with a mount means on the end for pivotally connecting the frame apparatus to the housing structure with the frame apparatus being pivotal from a first position with the spa cover situated on the spa folded over the cross member, to a second position with the spa cover folded over the cross member and vertically suspended adjacent one side of the housing structure wherein;

each side member has a bend, wherein the side members are configured to enhance the ratio of horizontal displacement of the cross member relative to vertical displacement when pivoting the folded spa cover from the position seated on the spa to the second vertical storage position adjacent the spa.

2. The spa cover lifting device of claim 1 wherein the mount means of the frame apparatus are positionable on opposite sides of the housing structure proximate the side to which the spa cover is vertically positionable.

3. The spa cover lifting device of claim 1 wherein each mount means comprises a flange connectable to the housing structure and an elbow assembly pivotally connected to the flange, the elbow assembly being connected to the side members for pivotal movement of the frame apparatus relative to the housing structure of the spa when the frame apparatus is mounted to the housing structure.

4. The spa cover lifting device of claim 1 wherein the lifting mechanism includes a limit means for limiting the pivot of the frame apparatus when the frame apparatus is pivoted.

5. The spa cover lifting device of claim 4 wherein the limit means comprises a tether.

6. A spa cover lift device for a spa on a support structure, the spa having a plurality of opposite sides and a top with a foldable spa cover having a central fold supportable on the top of the spa, the spa cover lift device comprising:

first and second tubular side elements having first and second ends, a pair of pivot brackets mountable to either one of the spa and support structure on opposite sides of the spa, one bracket of the pair being connected to the first end of one of the tubular side elements and the other bracket of the pair being connected to the first end of the other of the tubular side elements;

a tubular cross member positionable at the central fold of the spa cover, the cross member having opposite ends, one end connected to the second end of the first tubular side element, and the other end connected to the second end of the second tubular side element, wherein the spa cover is foldable over the cross member when the cross member is positioned at the central fold of the spa cover and transportable to a storage position with the spa cover vertically suspended from the cross member adjacent one of the sides of the spa, wherein the tubular side elements each have a bend with a first portion of each of the side elements being vertically oriented with the spa cover when the spa cover is in the storage position and a second portion that is horizontal when the spa cover is in said storage position.

7. The spa cover lift device of claim 6 wherein the pivot brackets are positionable on opposite sides of the spa proximate the side to which the spa cover is vertically positionable when moved to the storage position.

8. The spa cover lift device of claim 6 wherein each pivot bracket comprises a flange and an elbow assembly pivotally connected to the flange, the elbow assembly being connected to the tubular side elements for pivotal movement of the side elements and cross member relative to the spa.

9. The spa cover lift device of claim 6 wherein the lift device includes a limit means for limiting the pivot of the side elements and cross member when the side elements and cross member are pivoted.

10. The spa cover lifting device of claim 9 wherein the limit means comprises a tether.

11. The spa cover of claim 6 wherein the second portion of each of the side elements is horizontally positioned alongside one of two opposite sides of the spa.

* * * * *